US005899688A

United States Patent [19]

Fontana

[11] Patent Number: 5,899,688

[45] Date of Patent: May 4, 1999

[54] ROTARY HEARTH FURNACE

[75] Inventor: Piergiorgio Fontana, Genoa, Italy

[73] Assignee: Demag Italimpianti S.p.A., Italy

[21] Appl. No.: 08/907,885

[22] Filed: Aug. 11, 1997

[30] Foreign Application Priority Data

Sep. 6, 1996 [IT] Italy ..... GE96A0079

[51] Int. Cl.[6] ..... F27B 9/16

[52] U.S. Cl. ..... 432/139; 432/136; 432/152; 432/72

[58] Field of Search ..... 432/138, 139, 432/136, 152, 72

[56] References Cited

U.S. PATENT DOCUMENTS

| | | | |
|---|---|---|---|
| 3,787,171 | 1/1974 | Cromp | 432/72 |
| 4,133,636 | 1/1979 | Flynn | 432/72 |
| 4,662,840 | 5/1987 | Ellison | 432/72 |
| 4,701,214 | 10/1987 | Kaneko et al. | 75/38 |
| 5,186,741 | 2/1993 | Kotraba et al. | 75/484 |

FOREIGN PATENT DOCUMENTS

| | | |
|---|---|---|
| 0508166 | 10/1992 | European Pat. Off. . |
| 0692543 | 7/1994 | European Pat. Off. . |
| 7223077 | 2/1973 | France . |

*Primary Examiner*—Teresa Walberg
*Assistant Examiner*—Jiping Lu
*Attorney, Agent, or Firm*—Larson & Taylor

[57] ABSTRACT

A rotary furnace for the treatment of minerals, includes an annular chamber provided with a material feeder apparatus and discharge apparatus for the material, disposed adjacent one another in a certain sector of the chamber. A plurality of burners are arranged all along the annular chamber on the side walls and on the top wall thereof. The furnace further includes a conduit for extracting the discharge gases. The gases from a first zone of the chamber downstream of the feeder means and upstream of the gas extraction means, with respect to the direction of rotation of said hearth, are transferred into a second zone upstream of the material discharge means and downstream of the gas extraction means through forced conveying of the gases by suction at the first zone and by pressure delivery at the second zone. A flow regulator is used to regulate the forced conveying.

8 Claims, 3 Drawing Sheets

ROTARY HEARTH FURNACE

FIELD OF THE INVENTION

The present invention relates to furnaces for the treatment of minerals and in particular relates to rotary hearth furnaces.

BACKGROUND OF THE INVENTION

In the reductive thermal coal treatment of metallic minerals containing metal oxides, the use of rotary hearth furnaces is known. Such furnaces generally consist of an annular chamber having the bottom wall, the so-called rotary hearth, rotating relative to the remainder of the chamber, a plurality of burners being disposed on the side walls and on the top wall of the furnace. Pellets consisting of the mineral containing the metal oxide which is to be treated mixed with coal are usually introduced into the furnace and deposited on the rotary hearth, in order to favor the evolution of CO, which is the effective reducing agent. The heat supplied by the burners allows the heterogeneous coal/mineral mixture to reach the right temperature for the reduction reaction.

The furnaces constructed in this way have nevertheless disadvantages, both from the point of view of the economics of the operation and from the point of view of the environmental impact. On the one hand, the reaction of reducing the metal oxides with C, or rather CO, is in fact endothermic and therefore attains the best efficiency levels at elevated temperatures; Therefore, a good process yield involves a significant energy consumption which inevitably increases the operating costs.

On the other hand, the atmosphere in the interior of the furnace chamber is rich in CO and produces a discharge gas with high pollution potential; consequently, the environmental impact of the thermal coal treatment in question is rather great.

In EP-A-0 508 166 is described a rotary hearth furnace in which the waste gases are transferred from a first zone of the chamber downstream of the feeder means and upstream of the gas extraction means, with respect to the direction of rotation of the hearth, into a second zone upstream of the material discharge means and downstream of the gas extraction means, through an air-gas burner. The first zone is separated from the other parts of the chamber by a curtain that only allows the passage of the mineral on the surface of the rotary hearth. However, the flow rate of gases from the first zone to the second zone can't be regulated. Morever, the combustion of such gases in the second zone is not carried out as a diffused combustion, and this can affect the efficiency of the process.

SUMMARY OF THE INVENTION

It is the object of the present invention to provide a rotary hearth furnace which allows a lowering of both the energy costs and the pollution level of the discharges produced, in order to make the operation more advantageous economically and at the same time much more compatible from the environmental point of view. The furnace according to the present invention will also overcome the disadvantages of the above described furnace, providing means for the regulation of flow rate of gases and allowing the diffused combustion of the same.

The subject of the present invention is therefore a rotary hearth furnace for the treatment of minerals, comprising an annular chamber provided with feeder means and discharge means for the material, disposed adjacent one to another in a certain sector of the said chamber, a plurality of burners arranged all along the annular chamber on the side walls and on the top wall thereof, means for extracting the discharge gases, and means for transferring the gases from a first zone of the chamber downstream of the feeder means and upstream of the gas extraction means, with respect to the direction of rotation of said hearth, into a second zone upstream of the material discharge means and downstream of the gas extraction means, characterized in that said means for transferring are means for the forced conveying of the gases by suction at said first zone and by pressure delivery at this second zone, said means being provided with means for regulating the said forced conveying.

BRIEF DESCRIPTION OF THE DRAWINGS

Further advantages and features will be evident from the following detailed description of an embodiment of the present invention, given by way of non-limiting example, with reference to the attached drawings in which.

DESCRIPTION OF THE PREFERRED EMBODIMENT

Figure 1:
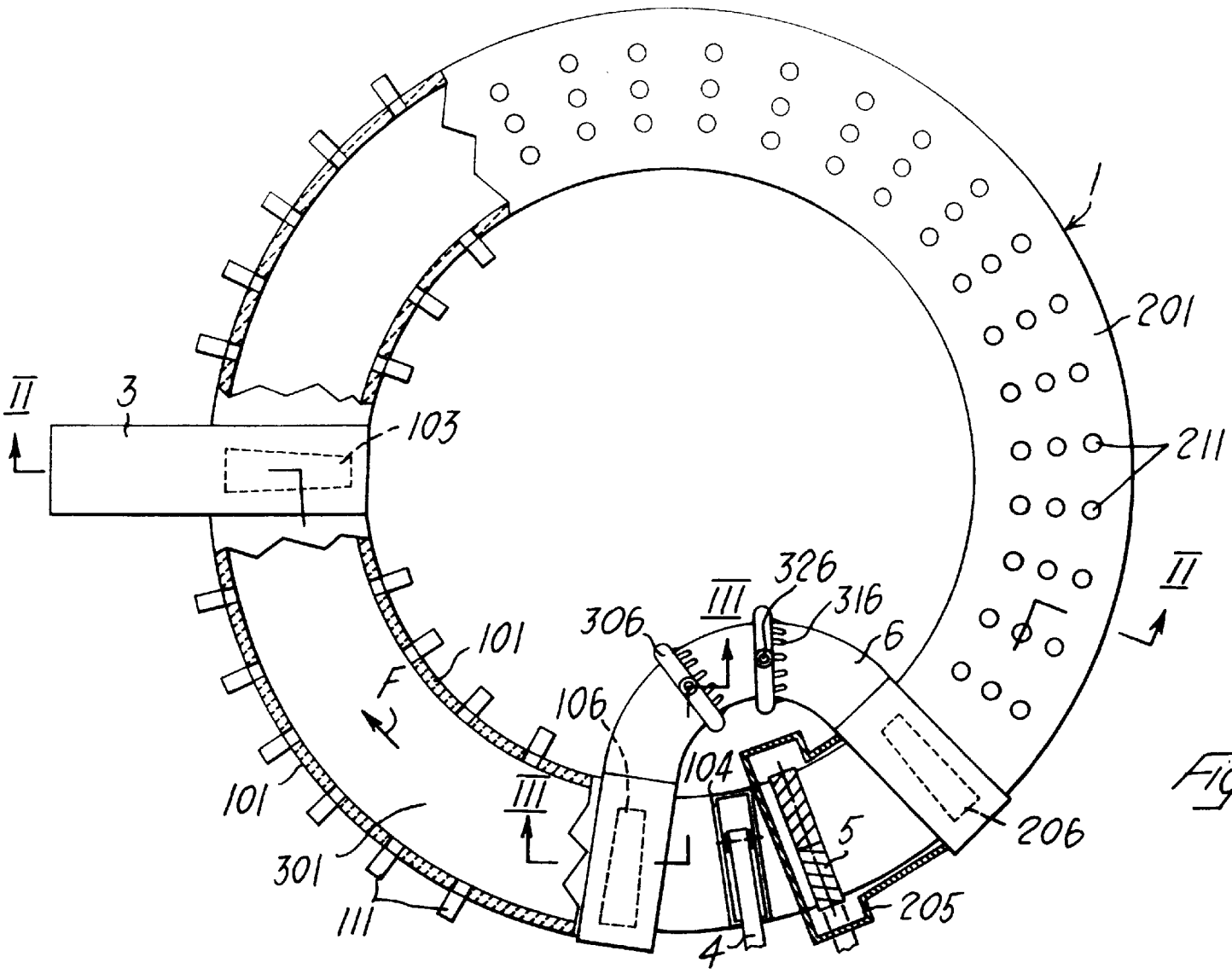
FIG. 1 shows a diagrammatic partially broken plan view of a rotary hearth furnace according to the present invention.

In FIG. 1, a rotary hearth furnace according to the invention is illustrated. The annular chamber 1 of the furnace is formed by a top 201 and two side walls 101 and a hearth 301 which rotates, owing to drive means not illustrated in the figure and not described in more detail, in the direction indicated by the arrow F. The chamber 1 is provided with a plurality of burners 111 disposed on the side walls 101 and a plurality of burners 211 disposed on its top 201. The furnace provides for means of feeding the material, which comprise a transporter belt 4 and a loading hopper 104 as well as, in the position adjacent to said feeder means, means for discharging the minerals reduced in the furnace, comprising a screw 5, a hopper 205 and a transporter belt 105. These discharge means are disposed in such a way that they are reached by the material which has completed the entire rotation of the chamber 1 on the hearth 301. At the two extremities of inlet into and exit from the chamber 1, placed respectively downstream of the mineral feeder means and upstream of the mineral discharge means, two ports 106 and 206 are located which are linked by a U-shaped conduit 6. The conduit 6 has two annular collectors 306 arranged coaxially thereto and provided with a plurality of nozzles 316 which open into said conduit 6. In a position about 90° downstream of the mineral feeder means is disposed the port 103, which communicates with the conduit 3 for extracting the discharge gases from the furnace.

Figure 2:
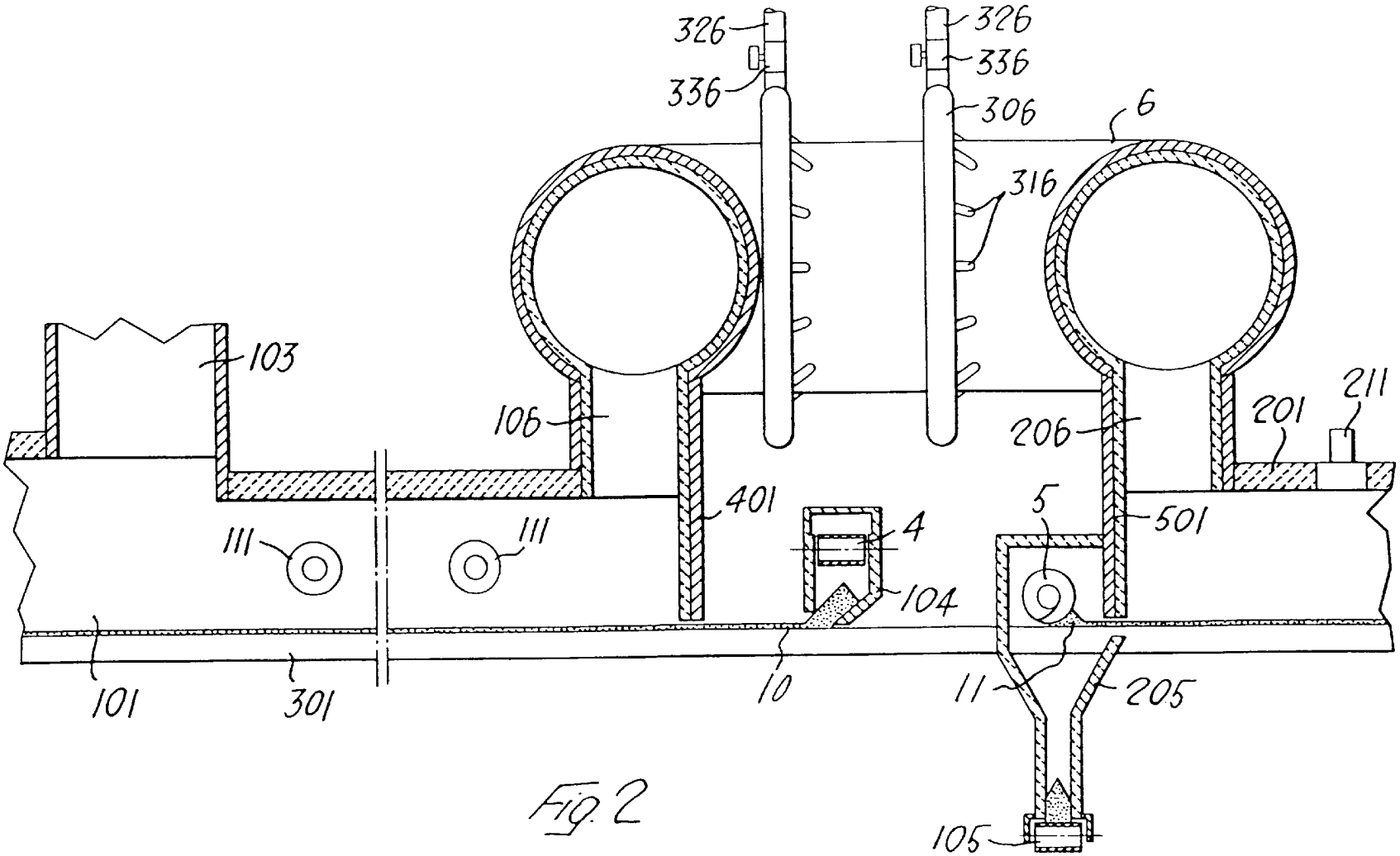
FIG. 2 shows a sectional view along the line II—II of the furnace illustrated in FIG. 1.

A view of a part of the furnace of FIG. 1 is illustrated in FIG. 2, in section along the line II—II. The same numerals correspond to the same parts in the two figures. The two walls disposed transversely in the interior of the chamber 1, namely the wall 401 downstream of the feeder means 4, 104 and the wall 501 upstream of the discharge means 5, 105, 205 can be seen in the figure. The two walls almost completely cut off the free space of the chamber 1, except for a small opening towards the hearth 301, on which the layer of mineral 10 is deposited by the hopper 104. From the opposite part, the screw 5 withdraws the reduced mineral 11 and throws it off again into the hopper 205. In the figure, are also shown two inlet ducts 326 connected to the annular collectors 306, and each provided with a flow rate regulating means, that is in this case the valve 336.

Figure 3:
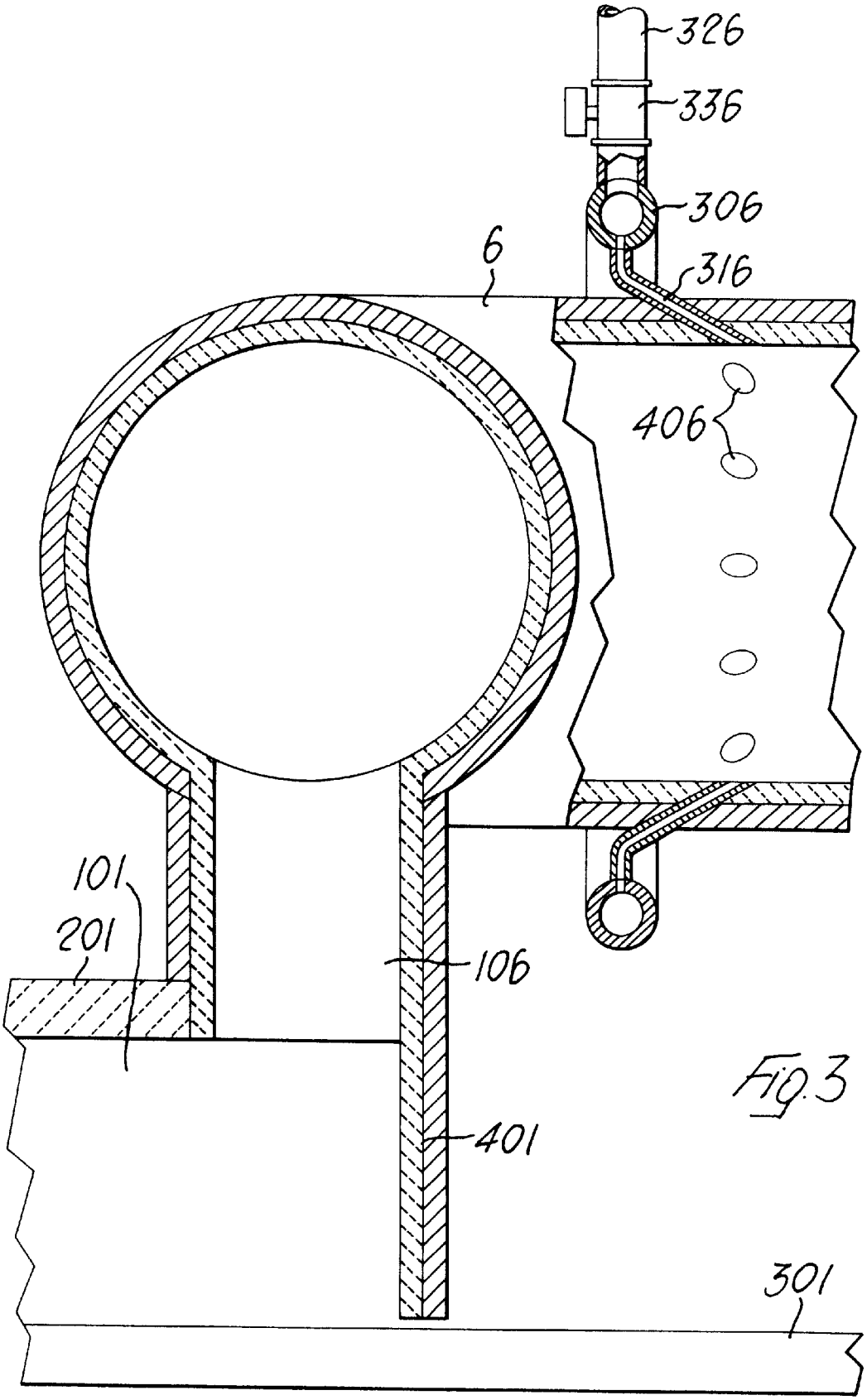
FIG. 3 is partial sectional enlarged view along the line III—III of the furnace illustrated in FIG. 1.

In FIG. 3 the cooperation between the conduit 6 and the annular collectors 306 is shown in more detail. The nozzles 316 can deliver their charge inside the conduit 6 through the openings 406 formed on the inner surface of the conduit 6.

The operation of the rotary hearth furnace according to the present invention will be clear from the following. The material 10, comprising the mineral which is to be treated mixed with the appropriate quantity of coal is carried to the hopper 104 by the belt 4, and is deposited as a thin and homogeneous layer on the hearth 301 by the hopper. At the inlet to the chamber 1, the material 10 is heated by the burners 111; under these conditions, the coal evolves CO and $CO_2$ and, in this way, the reaction of reducing the metal oxide contained in the mineral is initiated. The gas produced in the first tract of the chamber 1 of the rotary hearth furnace is then at a high CO concentration; on the one hand, this high concentration promotes the development of the reduction reaction but, on the other hand, makes the extraction of the gases produced critical.

In the furnace according to the invention, the suction of the gases through the port 106, owing to the nozzles 316 of the annular collectors 306, which by feeding gas in general and/or also air into the system in a controlled manner due to the regulating means 336, make it possible to effect the forced conveying of the gases between the two zones, overcoming the pressure difference between these and the pressure drop in the conduit 6 itself across the conduit 6, and subsequently it occurs the pressure delivery of such gases again through the port 206 into the tract upstream of the discharge means 5, 105, 205. In this way, gas of high energy content is delivered to this tract of the chamber 1, thus allowing the elevated temperature in the chamber to be maintained with significant fuel saving. Moreover, this novel combustion of the gas withdrawn from the first tract of the chamber guarantees a lower pollution level of the discharges issuing from the extraction conduit 3.

The gases that reach the said second zone of the chamber of the furnace can then carry out a diffused combustion, which is much more effective for the overall yield of the process.

In the figures, only a single suction zone of the gas produced in the chamber and a single pressure delivery zone are illustrated. Nevertheless, still within the same inventive concept, a rotary hearth furnace can be considered which provides for more suction ports at diverse points of the furnace and more gas pressure delivery ports.

What I claim is:

1. Rotary hearth furnace for the treatment of minerals, comprising an annular chamber including material feeder means and discharge means for the material disposed adjacent one another in a certain sector of the chamber, a plurality of burners arranged all along the annular chamber on the side walls and on the top wall thereof, means for extracting the discharge gases, and means for transferring the gases comprising means for the forced conveying of the gases from a first zone of the chamber downstream of the material feeder means and upstream of the gas extraction means, with respect to the direction of rotation of said hearth, into a second zone upstream of the material discharge means and downstream of the gas extraction means, said means for the forced conveying of the gases comprising a conduit connected at ends thereof to suction means disposed in said first zone and to pressure delivery means disposed in said second zone, the conduit including gas feeder means for feeding a gas into the conduit and means for regulating the forced conveying whereby pressure difference and pressure drop in the conduit itself is overcome to allow the gas which is to be transferred between the two zones of the chamber to be conveyed, rate controlled and combustion of the gases to be promoted.

2. Furnace according to claim 1, wherein said gas feeder means comprises at least one annular collector arranged coaxially to said conduit and having a plurality of nozzles which open into said conduit, each collector being connected to an inlet duct including a regulating valve.

3. Furnace according to claim 2 wherein said nozzles are inclined in a direction of flow of the gases in the conduit.

4. Furnace according to claim 1, wherein said suction means comprises at least one open port on the top wall of said chamber.

5. Furnace according to claim 4, wherein said port opens next to said material feeder means.

6. Furnace according to claim 1, wherein said pressure delivery means comprises at least one open port on the top wall of said chamber.

7. Furnace according to claim 6, wherein said port opens next to said discharge means for the material.

8. Furnace according to claim 1, wherein said first zone of said chamber comprises a sector of about 90° of amplitude between said feeder means for material and said gas extraction means.

* * * * *